US008826852B2

(12) United States Patent
Malone et al.

(10) Patent No.: US 8,826,852 B2
(45) Date of Patent: Sep. 9, 2014

(54) OPTIMIZED DOUBLE WASHER PULL PLUG FOR MINIMIZING COATING ERROR

(75) Inventors: Christopher Malone, Franksville, WI (US); Kissak Sarajian, Franksville, WI (US); Todd Schuh, Franksville, WI (US)

(73) Assignee: Engineered Products and Services, Inc., Franksville, WI (US)

( * ) Notice: Subject to any disclaimer, the term of this patent is extended or adjusted under 35 U.S.C. 154(b) by 313 days.

(21) Appl. No.: 12/758,678

(22) Filed: Apr. 12, 2010

(65) Prior Publication Data

US 2011/0247551 A1 Oct. 13, 2011

(51) Int. Cl.

| | |
|---|---|
| ***B05C 11/11*** | (2006.01) |
| ***B65D 43/04*** | (2006.01) |
| ***B05B 15/04*** | (2006.01) |
| ***B05C 21/00*** | (2006.01) |

(52) U.S. Cl.

CPC ..... *B05B 15/0462* (2013.01); *B05C 21/005* (2013.01); *Y10S 220/19* (2013.01)

USPC ..... 118/505; 118/504; 220/801; 220/802; 220/DIG. 19

(58) Field of Classification Search

USPC ..... 118/504, 505; 220/801, 287, DIG. 19

See application file for complete search history.

(56) References Cited

U.S. PATENT DOCUMENTS

| | | | | |
|---|---|---|---|---|
| 1,730,202 | A * | 10/1929 | Geyer | 220/801 |
| 2,363,660 | A | 11/1944 | Duggan | |
| 3,842,790 | A * | 10/1974 | Clark | 215/228 |
| 4,130,232 | A | 12/1978 | Anderson | |
| 4,268,349 | A | 5/1981 | Hacke et al. | |
| 4,400,123 | A | 8/1983 | Dunegan | |
| 4,640,434 | A | 2/1987 | Johnsen et al. | |
| 4,685,173 | A * | 8/1987 | Pavur | 16/2.2 |
| D291,933 | S | 9/1987 | Weiss | |
| 4,871,585 | A | 10/1989 | Kano et al. | |
| 4,940,135 | A | 7/1990 | Hall | |
| D315,621 | S | 3/1991 | Laymon et al. | |
| 5,270,085 | A | 12/1993 | Horiki et al. | |
| 5,328,723 | A | 7/1994 | Horiki et al. | |
| 5,356,255 | A | 10/1994 | Takahashi et al. | |
| D360,820 | S | 8/1995 | Haase | |
| 5,753,042 | A | 5/1998 | Bauer | |
| 5,788,774 | A | 8/1998 | Mccumiskey et al. | |
| D404,178 | S | 1/1999 | Wetzler | |
| D426,457 | S | 6/2000 | Sato et al. | |
| D429,627 | S | 8/2000 | Gradwell | |
| 6,230,958 | B1 | 5/2001 | Coletta et al. | |
| 6,253,987 | B1 | 7/2001 | Coletta et al. | |

(Continued)

OTHER PUBLICATIONS

Echo, Weld Nut Plugs 600F (315C), 2011 Echo Engineering & Production Supplies, Inc., [online], [site visited Jan. 12, 2012]. Available from Internet, <URL: http://www.echosupply.com/finishing-supplies-products.aspx?ID=91>.

(Continued)

*Primary Examiner* — Dah-Wei D Yuan
*Assistant Examiner* — Binu Thomas
(74) *Attorney, Agent, or Firm* — Michael Best & Friedrich LLP

(57) ABSTRACT

The present invention is an optimized DWP for minimizing coating error that has two centering components which center the DWP inside a threaded or non-threaded opening effectively masking the threads and/or opening during the coating process.

20 Claims, 7 Drawing Sheets

(56) References Cited

U.S. PATENT DOCUMENTS

| | | | | |
|---|---|---|---|---|
| 6,419,104 | B1 | 7/2002 | Sarajian | |
| D461,691 | S | 8/2002 | Huang et al. | |
| D491,325 | S | 6/2004 | Hawkins | |
| D498,134 | S | 11/2004 | Fujiwara | |
| 6,883,546 | B1 | 4/2005 | Kobylinski | |
| 7,114,632 | B2 * | 10/2006 | Kraus | 220/802 |
| 7,422,785 | B2 | 9/2008 | Ogawa et al. | |
| 7,504,133 | B2 * | 3/2009 | Cuyler et al. | 427/282 |
| 7,559,991 | B2 | 7/2009 | Burton et al. | |
| 2004/0056039 | A1 * | 3/2004 | Sarajian | 220/801 |
| 2007/0205207 | A1 | 9/2007 | Dornbach | |
| 2011/0247551 | A1 | 10/2011 | Malone et al. | |

OTHER PUBLICATIONS

Component Force, Weld Nut Plugs, 2011 Component Force USA LLC, [online], [site visited Jan. 12, 2012]. Available from Internet, <URL: http://www.componentforce.com/category/503/weld-nut-pull-plugs>.

Echo, Plugs, Echo Engineering & Production Supplies, Inc., [online], [site visited Jan. 12, 2012]. Available from Internet, <URL: http://www.echosupply.com/Finishing-Supplies.aspx?id=1>.

* cited by examiner

OPTIMIZED DOUBLE WASHER PULL PLUG FOR MINIMIZING COATING ERROR

CROSS-REFERENCE TO RELATED APPLICATIONS

None

FIELD OF INVENTION

The present invention relates to the field of masking devices, and more particularly to a double washer pull plug (DWP) for masking openings and threads during coating.

GLOSSARY

Figure 1A:
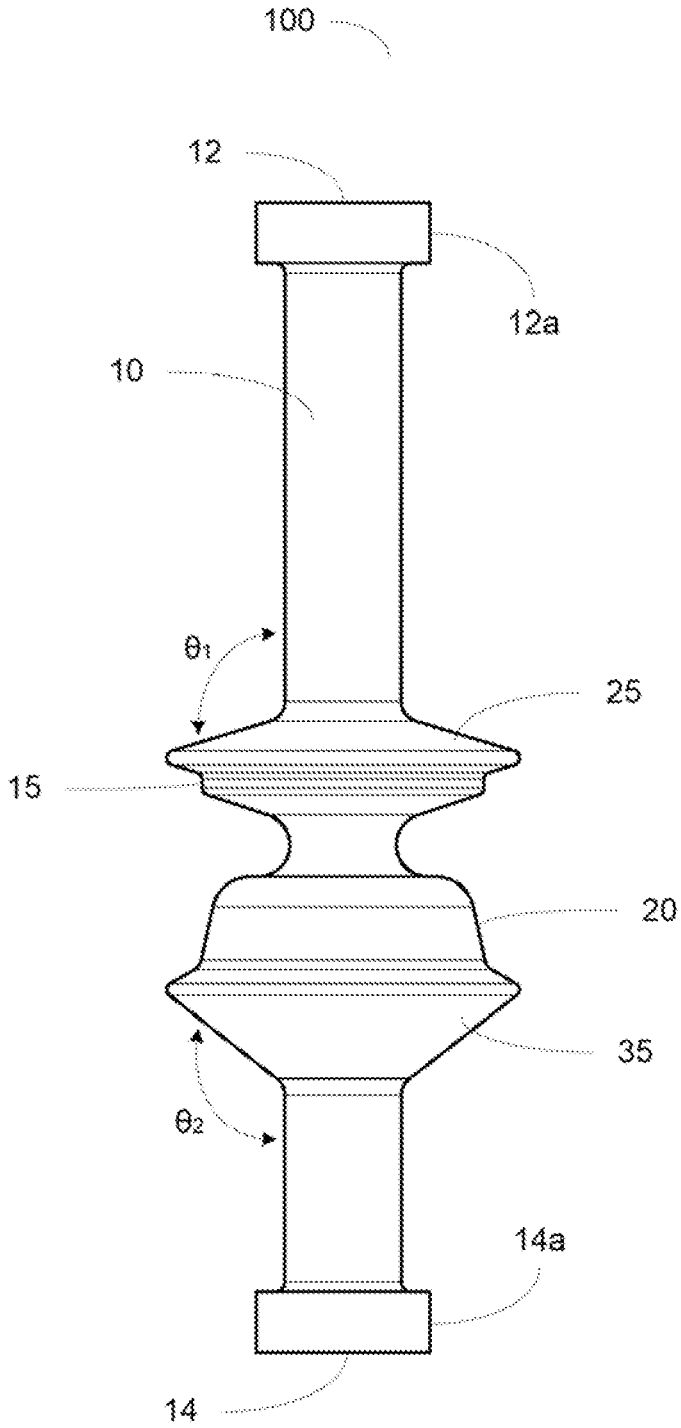
FIG. 1*a* illustrates a side perspective view of an exemplary embodiment of an optimized DWP.

As used herein, the term "coating" refers to a substance applied to a surface to form a layer. Examples of coating may include, but are not limited to powder coating, wet spray, e-coat, dipping, plating and treating.

As used herein, the term "coating error" refers to the distribution of coating particles on the threads of a weld nut, press nut or similar product or inside a non-threaded opening during the coating process.

As used herein, the term "coating particles" refers to the fragments which make up a layer of coating.

As used herein, the term "flexible" means capable of being bent, without breaking, allowing for temporary change in the shape of an object. An object or component (e.g., a flange) may be more or less flexible to facilitate movement, positioning and insertion in various embodiments.

As used herein, the term "centering component" or "thread engaging protuberance" refers to any portion of an optimized DWP that grips or engages against the entrance thread on both sides of a threaded opening (e.g., of a weld nut, press nut or similar product) or against the walls of an opening to facilitate positioning of an optimized DWP. The diameter of the centering component(s) of an optimized DWP corresponds to the diameter of the weld nut, press nut, similar product being used, or opening which is being masked.

As used herein, the term "flange" or "masking flange" refers to a protuberance, rim, ring or collar which covers a threaded or non-threaded opening.

As used herein, the term "threaded opening" refers to an aperture within a component which contains threads.

As used herein, the term "non-threaded opening" refers to an aperture within a component which does not contain threads.

As used herein, the term "entrance thread" refers to the outermost threads of a threaded component (e.g., a weld nut, press nut or similar product).

As used herein, the term "major diameter" refers to the diameter of a flange.

BACKGROUND

Many types of manufactured parts must be coated with various substances in order to achieve the necessary or preferred characteristics before they may be used. These parts, however, often include surface portions (e.g., internal surface portions) that should not be coated. Most parts often include one or more openings which during the coating process allow coating materials to come in contact with internal surface portions of the part. Depending on the specific application for the part, contact between the coating and the internal surface portions of the part can be undesirable and/or can severely damage the part. An estimated 9.8 million dollars are spent each year on rework to ensure quality.

Often the openings are threaded in order to engage with a threaded fastener or other part. The threads must engage the fastener or other part perfectly and the addition of coating particles disrupts the engagement of the threaded components. The protruding threads also interfere with the ability to mask the opening to prevent buildup of coating material.

Many products, such as pull plugs and double washer pull plugs, are known in the art for masking surface portions of a part that is to be coated in order to prevent the coating material from contacting such surface portions during the coating process.

Pull plugs, such as those taught by U.S. application Ser. No. 10/252,197 are designed to be seated in the part opening and to conform to the shape of the opening so that the plug segment engages the wall or threads of the part opening. The flange of the plug masks the edge of the part opening preventing coating material or other contaminants from coming in contact with the part opening and any threads and from moving through the opening.

These pull plugs, however, are not desirable because they mask only the thread covered by the flange of the pull plugs allowing only one surface of the part to be coated at a time. To effectively protect the threads proximate to the undersurface of the part, the pull plug needs to be removed and reinserted in the opposite direction so that the flange now masks those threads.

Figure 3A:
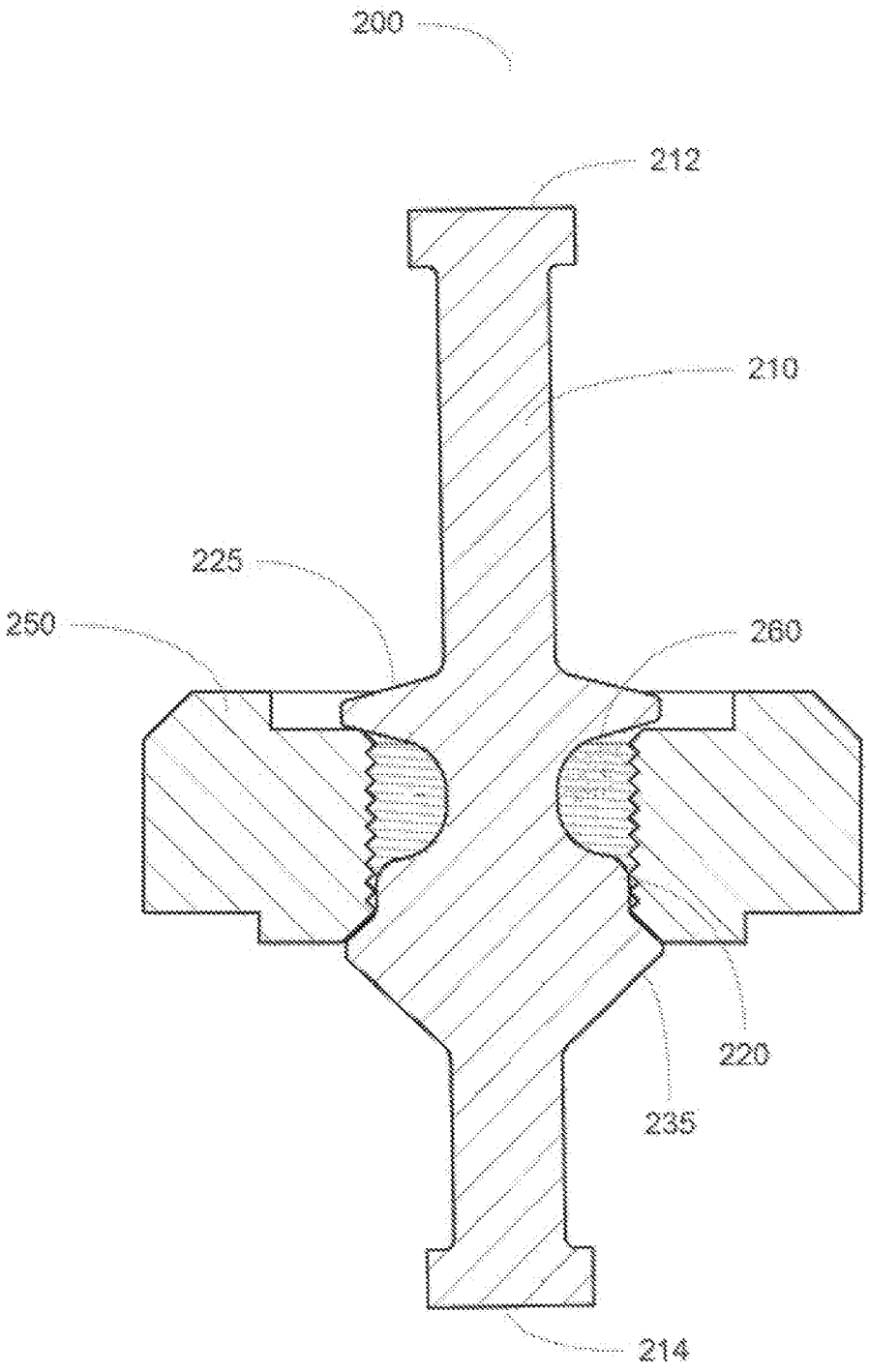
Figure 3a Prior Art
FIG. 3*a* illustrates a sectional view of a DWP known in the prior art positioned inside a weld nut.

Double washer pull plugs known in the art, such as the one shown in FIG. 3*a*, are designed to mask both sides of a threaded component (e.g., a weld nut) preventing coating particles and contaminants from damaging the threads and/or reaching the internal surface portions of the part. The design of the prior art, however, made it difficult to perfectly center the double washer pull plug inside the threaded component leaving one side partially exposed to the coating material. In addition, the difficulty in ensuring that the double washer pull plug is centered results in a variance in the range of masking quality within a single part.

It is desirable to have a plug which effectively masks both sides of a threaded or non-threaded component preventing coating error.

SUMMARY OF THE INVENTION

The present invention is an optimized DWP apparatus comprised of a cylindrical plug body having a first end and a second end, a first centering component, a second centering component, a first masking flange, and a second masking flange. Each of the masking flanges has a major diameter, a flexibility coefficient, and an angle $\theta_1$. The flexibility coefficient of the first masking flange is directly proportional to the amount of force necessary to pull said first masking flange through a predetermined opening that is to be masked. The cylindrical plug body, centering components and masking flanges are comprised of a material capable of withstanding temperatures of up to 600° F. The two centering components center the DWP inside a threaded or non-threaded opening effectively masking the opening and/or threads during the coating process minimizing coating error.

DETAILED DESCRIPTION OF INVENTION

For the purpose of promoting an understanding of the present invention, references are made in the text to exemplary embodiments of an optimized DWP, only some of which are described herein. It should be understood that no limitations on the scope of the invention are intended by describing these exemplary embodiments. One of ordinary skill in the art will readily appreciate that alternate but functionally equivalent materials, shapes and sizing may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change in the basic function to which it is related.

FIG. 1*a* illustrates a side perspective view of an exemplary embodiment of optimized DWP 100 comprised of plug body 10 having first end 12 and first gripping ridge 12*a*, second end 14 having second gripping ridge 14*a*, first centering component 15, and second centering component 20. In the embodiment shown, first centering component 15 includes first flange 25 and second centering component 20 includes second flange 35. In the embodiment shown, first flange 25 is more flexible than second flange 35 and bends when pressure is applied. For example, first flange 25 will bend when optimized DWP 100 is pulled through an aperture of a nut or other component having surfaces to be protected during the coating process.

In the embodiment shown, plug body 10, first end 12 and second end 14 are cylindrical with first gripping ridge 12*a* and second gripping ridge 14*a* having a slightly larger diameter than plug body 10. In the embodiment shown, first gripping ridge 12*a* and second gripping ridge 14*a* have flattened side edges and a flattened end and are visually identical. In various embodiments, first gripping ridge 12*a* and second gripping ridge 14*a* may have rounded side edges, a rounded end, have varying dimensions (e.g., height, diameter), and/or may be visually distinct.

In the embodiment shown, first and second centering components 15, 20 are substantially flat to correspond to the interior walls of an opening or the threads of a weld nut, press nut, or similar component.

In the embodiment shown, first centering component 15 and second centering component 20 have equal diameters and are larger in diameter than plug body 10; and first flange 25 and second flange 35 have a larger diameter than first and second centering components 15, 20. In the embodiment shown, first centering component 15 is thinner than second centering component 20.

In other embodiments, the diameters, shapes, thicknesses and flexibility of first and second centering components, and the distance between first and second centering components may vary depending on the size and shape of the threaded component that is to be masked. Depending on the application, the first and second centering components may both include thinner, more flexible flanges and/or have identical dimensions.

In the embodiment shown, first and second centering components 15, 20 are not centered vertically on plug body 10 and the distance between first end 12 and first centering component 15 is greater than the distance between second centering component 20 and second end 14. In other embodiments, the distances between the centering components and the ends of the plug body may vary, i.e., the distance between second centering component and second end may be greater than the distance between first centering component and first end or the distances may be equal.

In the embodiment shown, the portion of plug body 10 located between first and second centering components 15, 20 is concave, but in other embodiments may be straight depending on the masking application. In various embodiments, the distance between first and second centering components 15, 20 may also vary depending on the masking application. For example, the distance between first and second centering components 15, 20 may vary with the height of the opening or threaded component.

In the embodiment shown, optimized DWP 100 is manufactured from silicone and is flexible which allows the optimized DWP 100 to be inserted into a weld nut, press nut or other component and to conform to the threads of the threaded component. Optimized DWP 100 is reusable, and does not migrate, melt or harden allowing it to be used to mask openings in processes, such as powder coating, liquid coating, e-coating, anodizing and plating. In other embodiments, optimized DWP 100 is manufactured from another flexible material, such as EPDM rubber, cork, nylon, synthetic polymers, elastomers, equivalents and combinations thereof.

In the embodiment shown, angle $\theta_1$, which represents the angle between cylindrical plug body 10 and first flange, is 107 degrees and angle $\theta_2$, which represents the angle between cylindrical plug body 10 and second flange, is 128 degrees. In still other embodiments, angles $\theta_1$, $\theta_2$ may range from 10 to 170 degrees.

Figure 1B:
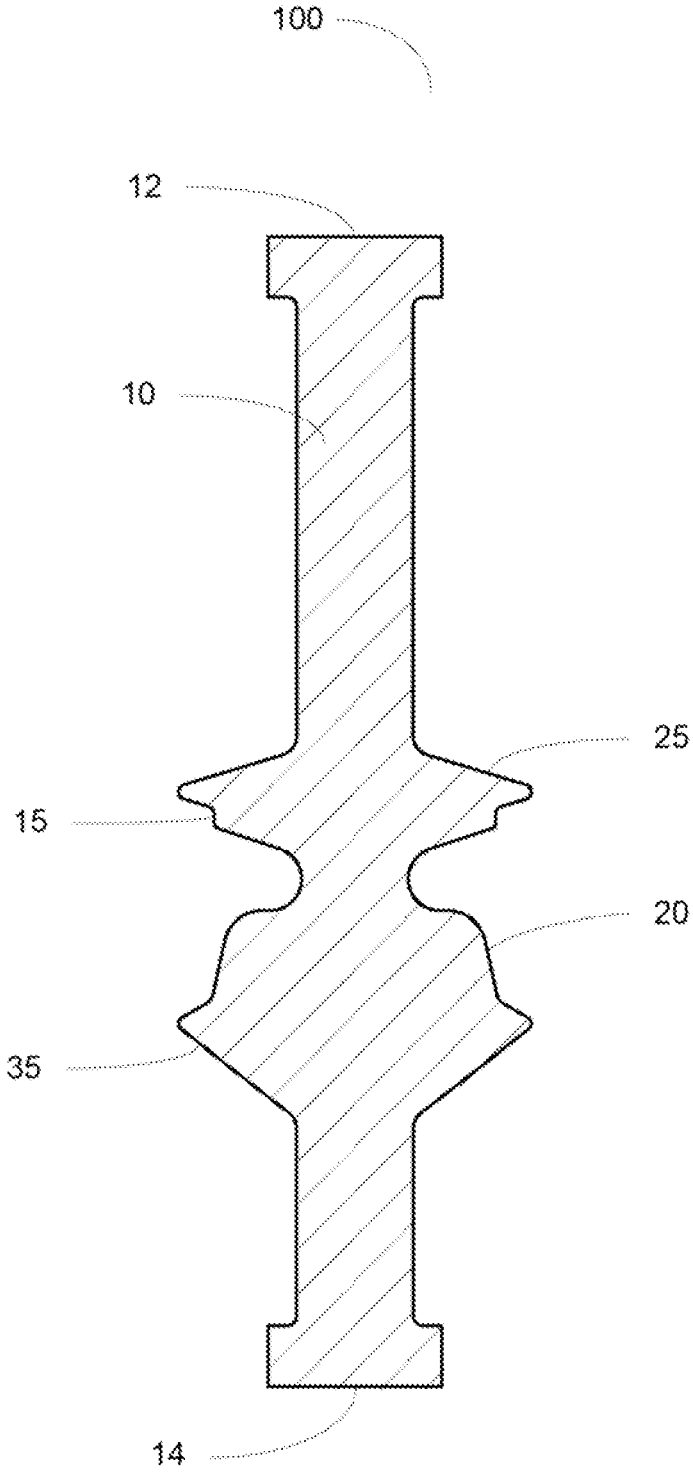
FIG. 1*b* illustrates a sectional view of an exemplary embodiment of an optimized DWP.

FIG. 1*b* illustrates a sectional view of an exemplary embodiment of optimized DWP 100.

Figure 2:
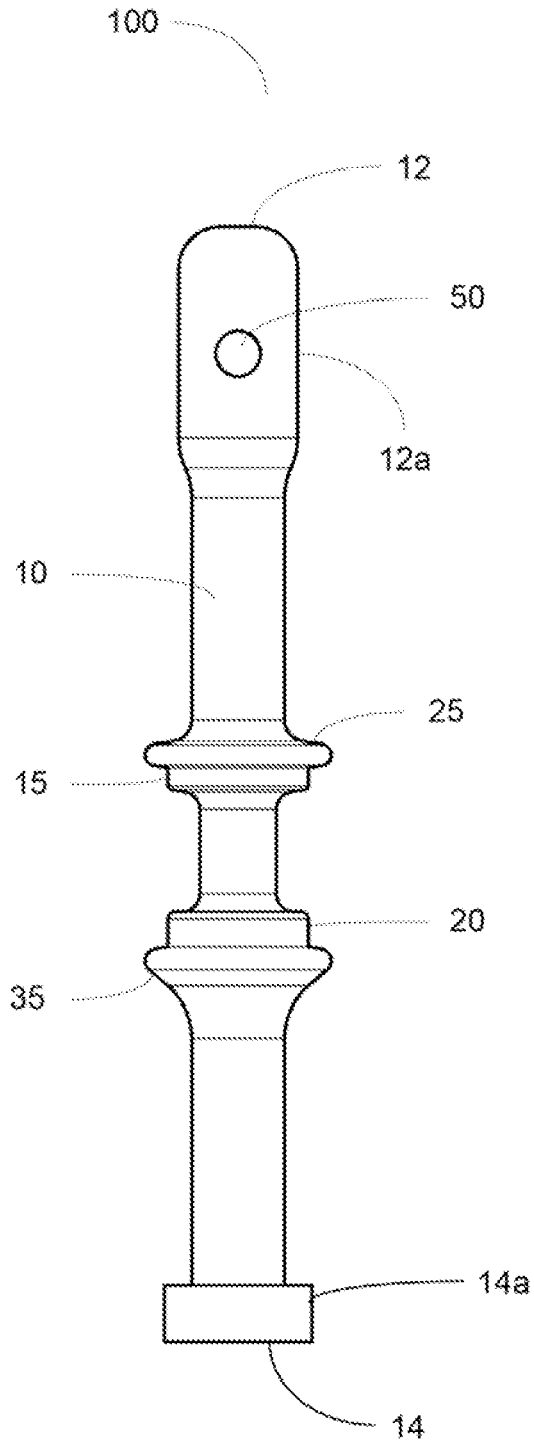
FIG. 2 illustrates a side perspective view of a second exemplary embodiment of an optimized DWP used for hanging parts.

FIG. 2 illustrates a side perspective view of a second exemplary embodiment of optimized DWP 100 used for hanging parts for coating lines. In the embodiment shown, first end 12 is rounded and has aperture 50 for inserting a hook used to hang optimized DWP 100.

In the embodiment shown, first centering component 15 includes first flange 25 and second centering component 20 includes second flange 35. In other embodiments, both first and second centering components 15, 20 have a flexible flange or have flanges that are of varying thickness and flexibilities. In various embodiments, first flange may be more flexible than second flange or first and second flange may be equally flexible.

In the embodiment shown, the portion of plug body 10 located between first and second centering components 15, 20 is straight, but in other embodiments may be concave, convex or of another shape depending on the masking application.

To hang a part for coating, first end 12 is inserted through a threaded or non-threaded opening in the part and optimized DWP 100 is pushed/pulled through until first flange 25 rests on the opposite side of the opening. When hung, the part rests on second flange 35 of second centering component 20. In the embodiment shown, the thickness of second flange 35 makes it more rigid than first flange 25 and therefore more capable of supporting the weight of a part.

In various embodiments, DWP 100 may further include a conductive material (e.g., carbon particles mixed in with silicone) for use with an electrostatic coating hanging system. Adding a conductive material to DWP 100 permits the charge to flow between the electrostatic system and the part, allowing the electrostatic coating system to function properly by attracting the oppositely charged coating particles to the part.

The distance between the first and second centering components 15, 20 may vary depending of the weight of the part which is hung using DWP 100. For example, for heavier parts, the distance between first and second centering components 15, 20 may be decreased to prevent the part from unseating itself.

In the embodiment shown, first end 12 is rounded and second end 14 is flat with gripping ridge 14*a*. This helps the user to identify which end has aperture 50 and is nearest to first centering component 15 and first flange 25. In other embodiments, first and second centering components 15, 20 each have an aperture for hanging.

FIG. 3*a* illustrates a sectional view of DWP 200 positioned inside weld nut 250. DWP 200 is one example of a double washer pull plug known in the prior art and is comprised of plug body 210 having first end 212 and second end 214, first flange 225, second centering component 220, and second flange 235.

To insert DWP 200 into weld nut 250, first end 212 is pushed through the opening in the bottom of weld nut 250 so that first flange 225 emerges from threaded region 260 and rests above the entry thread of weld nut 250. In the embodiment shown, DWP 200 does not have a first centering component which engages the threads of threaded region 260 ensuring that DWP 200 remains centered. In the embodiment shown, DWP 200 is not centered in weld nut 250 and therefore does not effectively mask threaded region 260.

Figure 3B:
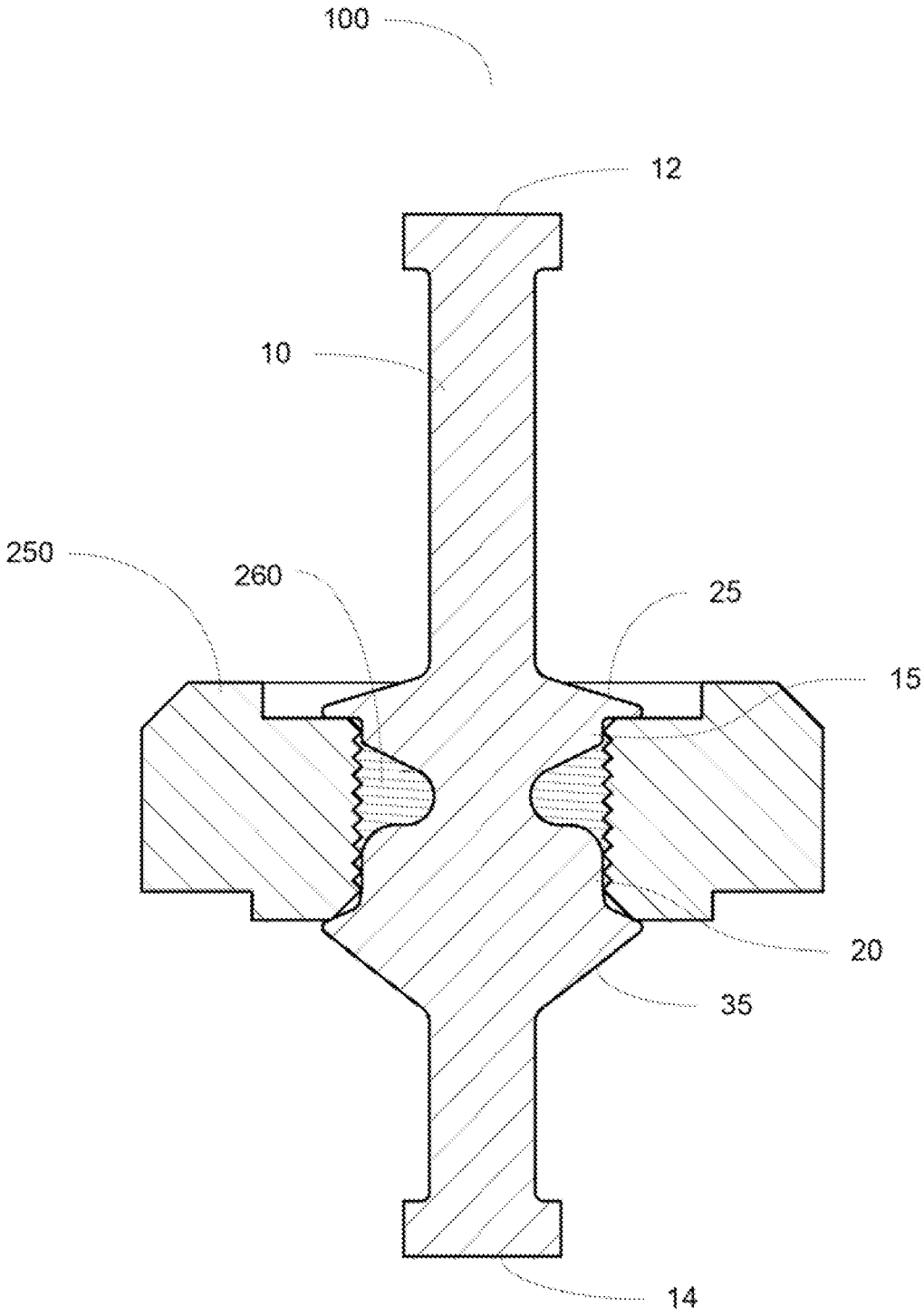
FIG. 3*b* illustrates a sectional view of an exemplary embodiment of an optimized DWP positioned inside a weld nut.

FIG. 3*b* illustrates a sectional view of an exemplary embodiment of optimized DWP 100 positioned inside weld nut 250 so that first centering component 15 engages the entry threads of weld nut 250 and second centering component 20 engages the exit threads of weld nut 250. The inclusion of both first and second centering components 15, 20 ensures that optimized DWP 100 is centered inside weld nut 250 effectively masking threaded region 260.

The distance between first flange 25 and second flange 35 corresponds to the length of the opening or threaded region of the weld nut, press nut or similar component and the diameter of first and second centering components 15, 20 corresponds to the diameter of the opening or threaded region of the weld nut, press nut or similar component.

Figure 4:
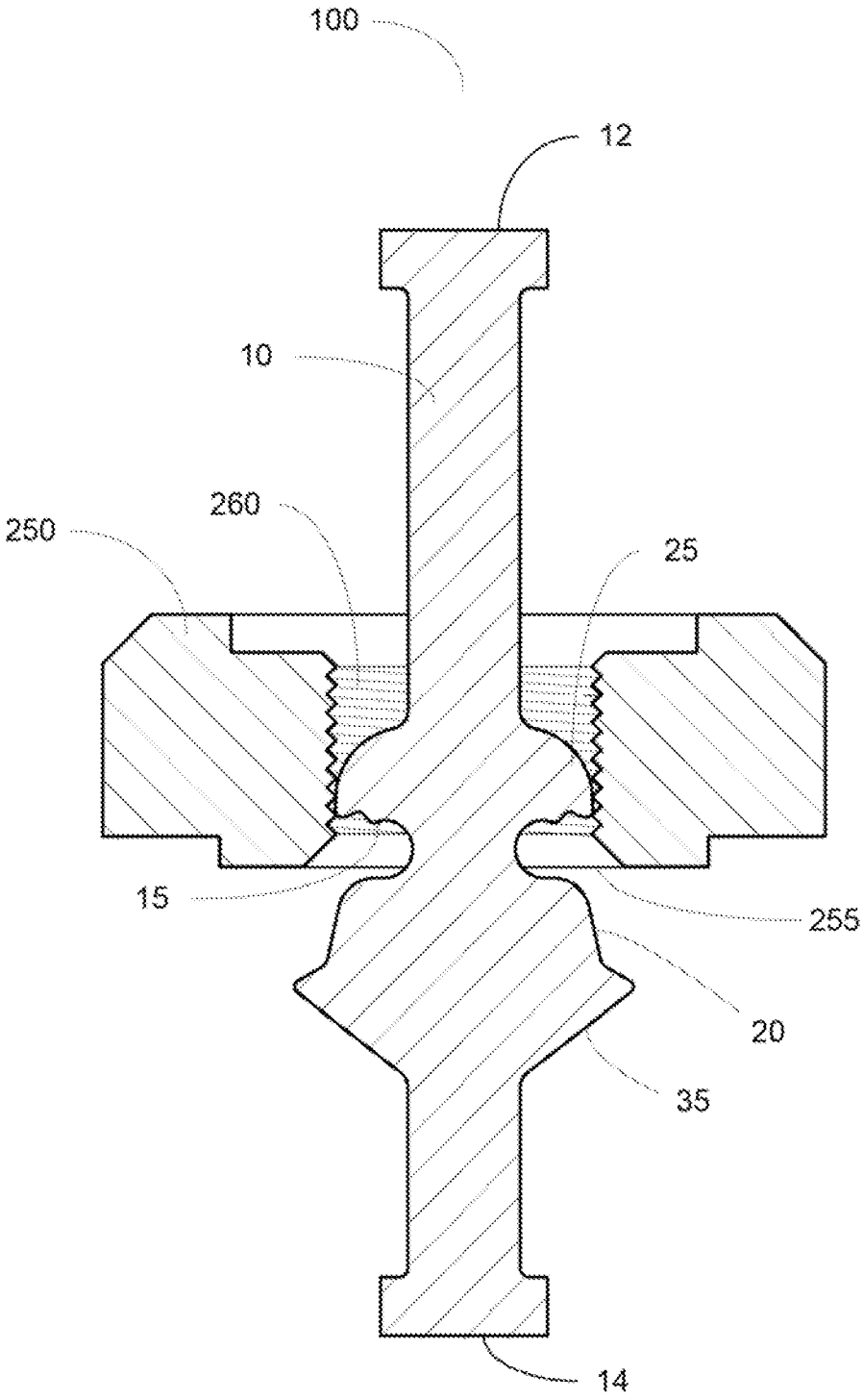
FIG. 4 illustrates a sectional view of an exemplary embodiment of an optimized DWP being positioned inside a weld nut.

FIG. 4 illustrates a sectional view of an exemplary embodiment of optimized DWP 100 being positioned inside the threaded opening of weld nut 250. First end 12 of optimized DWP 100 is inserted into opening 255 of weld nut 250 and pushed through threaded region 260. First flange 25 and first centering component 15 flex downward allowing DWP 100 it to be pushed through threaded region 260. When first end 12 emerges from threaded region 260, optimized DWP 100 can then be pulled through threaded region 260 and centered so that first flange 25 rests on the opposite side of threaded region 260. First flange 25 will straighten when it exits threaded region 260.

To remove optimized DWP 100 from a threaded or non-threaded opening once the coating process is complete, second end 14 is pulled and first flange 25 flexes outward allowing it to pass through the opening (e.g., threaded region 260).

In the embodiment shown, only first flange 25 is flexible; however, in other embodiments where both flanges are flexible or semi-flexible, it may be possible for either first flange 25 or second flange 35 to pass through a threaded or non-threaded opening allowing either end to be pushed/pulled to insert/remove optimized DWP 100.

Figure 5:
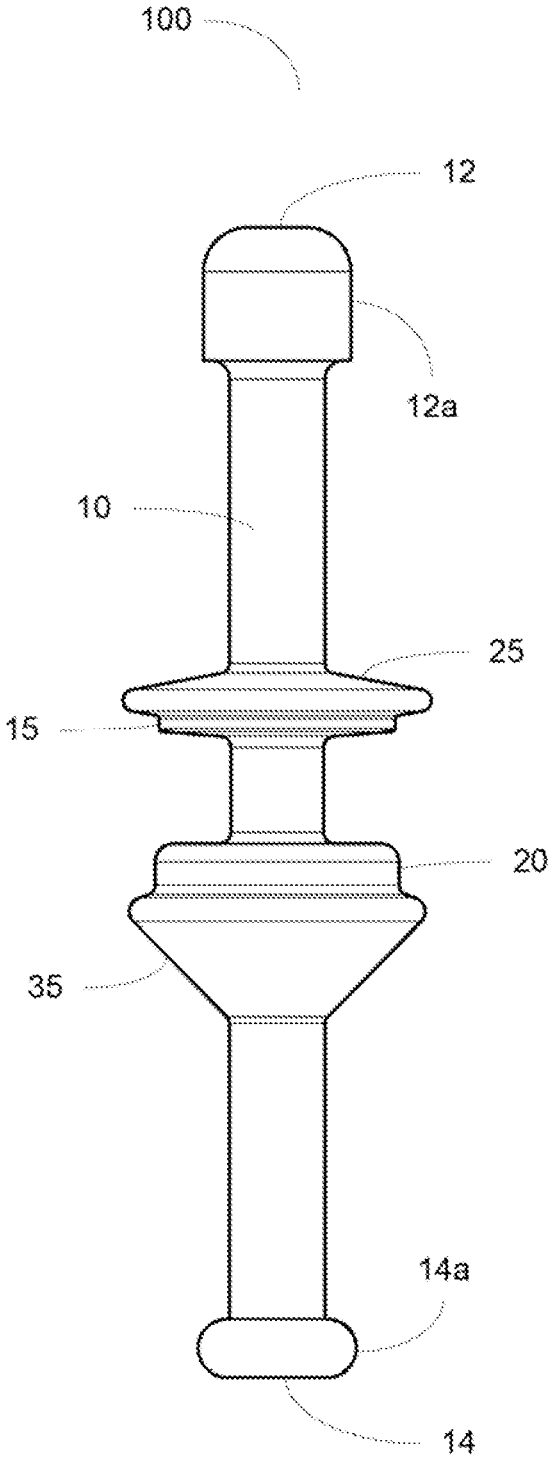
FIG. 5 illustrates a side perspective view of a third exemplary embodiment of an optimized DWP.

FIG. 5 illustrates a side perspective view of a third exemplary embodiment of optimized DWP 100. In the embodiment shown, DWP 100 has visually distinct ends which provide a visual clue as to the centering component(s) having the flexible flange (e.g., first flange 25) so the user knows which end should be used to remove optimized DWP 100 from the opening. First gripping ridge 12*a* has flattened side edges and a rounded end. Second gripping ridge 14*a* has rounded side edges and a flattened end. In the embodiment shown, first gripping ridge 12*a* has a height that is greater than that of second gripping ridge 14*a*.

In various embodiments, first gripping ridge 12*a* and second gripping ridge 14*a* may have rounded or straight side edges, a straight or rounded end, have varying dimensions (e.g., height, diameter), and/or may be visually identical.

What is claimed is:

1. An optimized dual washer pull plug apparatus for masking a mechanical part, the mechanical part having a first side, a second side, and an aperture that extends from the first side to the second side, the optimized dual washer pull plug comprised of:

a plug body having a first end and a second end;

a first centering component between the first end of the plug body and the second end of the plug body, the first centering component having a first end and a second end and the first centering component having a length between the first and second ends of the first centering component, a diameter between the first and second ends of the first centering component, and being generally cylindrical between the first and second ends of the first centering component;

a second centering component between the first centering component and the second end of the plug body, the second centering component having a first end and a second end and the second centering having a length between the first and second ends of the second centering component, a diameter between the first and second ends of the second centering component, and being generally cylindrical between the first and second ends of the second centering component, the length of the second centering component greater than the length of the first centering component;

a first masking flange at the first end of the first centering component, the first masking flange having a first major diameter, a first flexibility coefficient, and an angle $\theta_1$, said first flexibility coefficient directly proportional to the amount of force necessary to pull said first masking flange through the aperture of the mechanical part; and a second masking flange at the first end of the second centering component, the second masking flange having a second major diameter, a second flexibility coefficient, and an angle $\theta_2$, wherein said plug body, said first centering component, said second centering component, said first masking flange, and said second masking flange withstanding temperatures of up to 600° F., wherein the first centering component is configured to center the first masking flange relative to the aperture of the mechanical part on the first side of the mechanical part, wherein the second centering component is configured to center the second masking flange relative to the aperture of the mechanical part on the second side of the mechanical part, wherein the plug body has a diameter between the first and second centering components that is less than the diameter the first centering component and less than the diameter of the second centering component, and wherein the first masking flange has a thickness less than the second masking flange such that the first masking flange is more flexible than the second masking flange.

2. The apparatus of claim 1 wherein said first and said second centering components are adapted to fit securely against an interior surface of an entrance thread of the mechanical part forming a barrier that is impenetrable by coating particles.

3. The apparatus of claim 1, wherein said first masking flange has a thickness of 20/1000 inch to ¼ inch.

4. The apparatus of claim 1 wherein said first masking flange has a major diameter 105 to 200% greater than a diameter of the aperture of the mechanical part.

5. The apparatus of claim 1 wherein said angle $\theta_1$ ranges from 10 to 170 degrees.

6. The apparatus of claim 1 wherein said angle $\theta_2$ ranges from 10 to 170 degrees.

7. The apparatus of claim 1 wherein said first end of the plug body further includes a first gripping ridge and said second end of the plug body further includes a second gripping ridge.

8. The apparatus of claim 1 wherein said apparatus is adapted for use with a weld nut.

9. The apparatus of claim 1 wherein said apparatus is adapted for use with a press nut.

10. The apparatus of claim 1 wherein at least one of said first end and said second end further includes an aperture for hanging a part that is to be coated on a coating line.

11. The apparatus of claim 1, wherein the first and the second centering components are between the first and the second masking flanges.

12. The apparatus of claim 1, wherein the diameter of the first centering component is equal to the diameter of the second centering component.

13. The apparatus of claim 1, wherein a portion of the plug body between the first centering component and the second centering component is concave.

14. An optimized dual washer pull plug apparatus comprised of:

a mechanical part, the mechanical part including a first side, a second side, an aperture that extends from the first side to the second side;

a plug body having a first end and a second end;

a first centering component between the first end of the plug body and the second end of the plug body, the first centering component having a first end and a second end and the first centering component having a length between the first and second ends of the first centering component and being generally cylindrical between the first and second ends of the first centering component;

a second centering component between the first centering component and the second end of the plug body, the second centering component having a first end and a second end and the second centering having a length between the first and second ends of the second centering component and being generally frusto-conical between the first and second ends of the second centering component, the length of the second centering component greater than the length of the first centering component;

an angular shaped first masking flange at the first end of the first centering component, the first masking flange having a first major diameter, a first flexibility coefficient, and an angle $\theta_1$, said first flexibility coefficient directly proportional to the amount of force necessary to pull said first masking flange through the aperture of the mechanical part;

a triangular shaped second masking flange at the first end of the second centering component, the second masking flange having a second major diameter, a second flexibility coefficient, and an angle $\theta_2$; and wherein said plug body, said first centering component, said second centering component, said first masking flange, and said second masking flange withstanding temperatures of up to 600° F., wherein the first centering component is received in the aperture of the mechanical part to center the first masking flange relative to the aperture of the mechanical part on the first side of the mechanical part to mask the aperture, and wherein the second centering component is received in the aperture of the mechanical part to center the second masking flange relative to the aperture of the mechanical part on the second side of the mechanical part mask the aperture, and wherein the first masking flange has a thickness less than the second masking flange such that the first masking flange is more flexible than the second masking flange.

15. The apparatus of claim 14, wherein the mechanical part includes threads located within the aperture, and wherein the first and second centering components engage the threads when the first and second centering components are located within the aperture of the mechanical part.

16. The apparatus of claim 14, wherein the first major diameter of the first masking flange is 105 to 200% greater than a diameter of the aperture of the mechanical part.

17. The apparatus of claim 14, wherein the mechanical part includes a weld nut.

18. The apparatus of claim 14, wherein the mechanical part includes a press nut.

19. The apparatus of claim 14, wherein the first centering component has a diameter between the first and second ends of the first centering component, wherein the second centering component has a diameter between the first and second ends of the second centering component, wherein the plug body has a diameter between the first and second centering components that is less than the diameters of the first and second centering components.

20. The apparatus of claim 19, wherein a portion of the plug body between the first centering component and the second centering component is concave.

* * * * *